United States Patent [19]

Coste et al.

[11] Patent Number: 4,826,419

[45] Date of Patent: May 2, 1989

[54] APPARATUS FOR RELAXING STRESSES AT THE END OF OEDOMETRIC COMPACTING OF A MIXTURE OF AN AGGREGATE AND A BINDER

[76] Inventors: Benoit Coste, Le Clos Minoret-Rue Bonrieux; Claude Vanvoren, L'Echaillon-Hermillon, both of 73300 Saint Jean de Maurienne, France

[21] Appl. No.: 65,878

[22] Filed: Jun. 24, 1987

[30] Foreign Application Priority Data

Jul. 4, 1986 [FR] France ..... 86 10128

[51] Int. Cl.[4] ..... B28B 3/02

[52] U.S. Cl. ..... 425/330; 100/219; 100/232; 249/160; 249/162; 264/120; 425/451.7; 425/451.9

[58] Field of Search ..... 100/219, 232; 249/82, 249/155, 158, 160, 161, 162; 264/120; 425/77, 330, 450.1, 451.4, 451.7, 451.9

[56] References Cited

U.S. PATENT DOCUMENTS 1,625,129 4/1927 Meyers ..... 100/232
1,863,609 6/1932 Vanderkloot ..... 100/232
3,056,653 10/1962 Slayter ..... 425/330
4,666,389 5/1987 Relis et al. ..... 425/450.1

FOREIGN PATENT DOCUMENTS 552861 5/1923 France ..... 425/330

*Primary Examiner*—Jay H. Woo
*Assistant Examiner*—C. Scott Bushey

[57] ABSTRACT

The invention relates to a process for relaxing lateral stresses at the end of shaping by compacting of a block constituted by an aggregate and a binder (such as a carbon-containing paste), to which is applied a main monoaxial stress in a rigid mold having a bottom and four side walls. According to the process, at the end of compacting and along the compacting axis, there is maintained a residual stress of between 50 and 2000 kilopascals, and preferably between 100 and 500 kilopascals. At least two of the side walls of the mold are then moved apart by a few millimeters, followed by the elimination of the main stress and the extraction of the molded block. The residual stress is maintained for a period of between 1 and 20 seconds following the moving apart of the walls.

2 Claims, 1 Drawing Sheet

APPARATUS FOR RELAXING STRESSES AT THE END OF OEDOMETRIC COMPACTING OF A MIXTURE OF AN AGGREGATE AND A BINDER

BACKGROUND OF THE INVENTION

1. Field of the Invention

The invention relates to a process and an apparatus for the lateral relaxation of stresses at the end of oedometric compacting of a block constituted by an aggregate and a binder shaped by vibratory tamping or ramming.

It applies more particularly, but not exclusively, to the production of carbon-containing blocks, constituted by coke and/or anthracite (aggregate) and pitch (binder) used in electrometallurgy, e.g. anodes and cathode elements to be used in vessels for the production of aluminium by electrolysis.

2. Description of Related Art

Oedometric compacting of a block or shaped member by vibratory tamping or ramming consists of placing the material to be shaped in a mould equipped with a cover and imparting thereto one or more stress cycles. These stresses are applied by the repeated dropping of a weight onto the material (ram or heavy cover).

In order to facilitate understanding of the invention, it is pointed out that vibratory tamping is obtained by the use of a heavy cover and the application to the mould of vibrations at a frequency between a few cycles and a few dozen cycles, which has the effect of raising the cover and which then drops under the effect of its own weight onto the block to be compacted.

Ramming consists of applying repeated shocks or impacts to the block by means of a ram, which is raised and allowed to fall in a periodic manner.

FIGS. 1, 2 and 3 relate to the prior art.

FIGS. 4, 5, 6, 7 and 8 relate to the invention.

All the drawings are diagrammatic sections and relate to the particular case where the main stress is exerted vertically from top to bottom, but still apply no matter what the position of the mould in space.

FIG. 1 shows that the main stress Fa is exerted vertically on the material (1) in mould (2). The mould sidewalls (3) are fixed and exert on the material a reaction Fl proportional to the main stress: $Fl = k \times Fa$.

Hereinafter, the term "lateral stress" will be used to define any stress exerted in a direction perpendicular or substantially perpendicular to the direction of the vertical stress.

At the end of compacting (which can e.g. last a few minutes), cover (4) is removed and the material (1) which had stored the lateral stresses will now release them. The sidewalls of mould (3) are fixed, so that the stresses can only be released in the direction of the compacting axis and can lead to the formation of cracks (6) perpendicular to the compacting axis. This is e.g. what occurs during the moulding of anodes for the production of aluminium by electrolysis, when the carbon-containing paste in the mould exceeds a certain critical temperature.

SUMMARY OF THE INVENTION

The object of the invention is a process for the lateral relaxation of stresses at the end of shaping by oedometric compacting of a block constituted by an aggregate and a binder and to which is applied a monoaxial stress in a rigid mould having a bottom and four sidewalls. Hereinafter, the term "compacting" will be used for the operation of shaping blocks in a mould, whilst the terms "bottom" and "top" do not prejudge the position of the mould in space.

According to the invention, at least two opposite sidewalls are rendered mobile, so that they can move back a few millimeters with respect to the moulded block (1), but are firmly maintained in place throughout the compacting period. It is also possible to make the four walls mobile.

Compacting is effected either by vibratory tamping, or by ramming.

Another object of the invention is an apparatus for performing the compacting process making it possible to ensure a limited backward movement (of a few millimeters) of the mobile walls following compacting, whilst maintaining them firmly blocked during the actual compacting.

BRIEF DESCRIPTION OF THE DRAWINGS

FIG. 4 diagrammatically illustrates the compacting under the action of the force Fa exerted by cover (4) or by the piston or pistons (4,4A).

FIG. 7 shows the embodiment of FIG. 4 taken along section line AB.

DESCRIPTION OF THE PREFERRED EMBODIMENTS

In the diagrammatic drawings 4,5 and 6, reference (4) designates the cover of a vibratory tamping device or a ram, whilst (4A) designates the fixed bottom of the mould. The walls of the mould (7) and (8) subject to a lateral thrust exert a reaction Fl.

Figure 1:
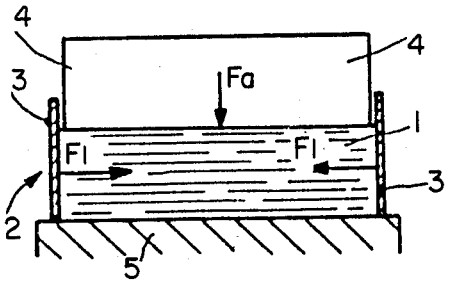
FIG.1 PRIOR ART
FIGS. 1–3 diagrammatically illustrate compaction according to the prior art.
Figure 4:
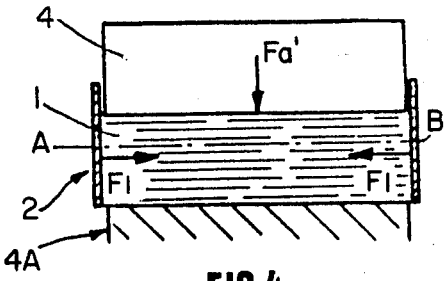
FIGS. 4–8 diagrammatically illustrate the realization of the invention in the particular case where the main stress is vertical.
Figure 2:
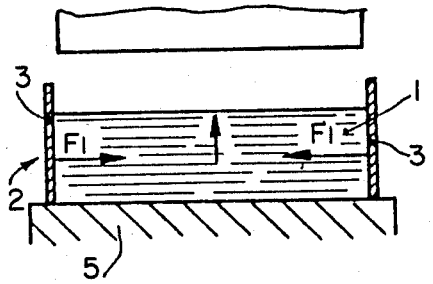
FIG.2 PRIOR ART
Figure 5:
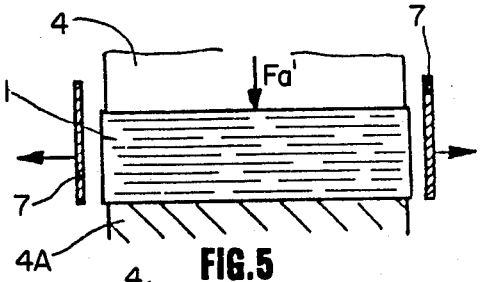
Figure 3:
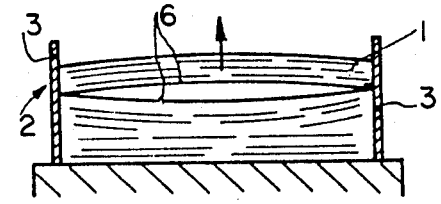
FIG.3 PRIOR ART
Figure 6:
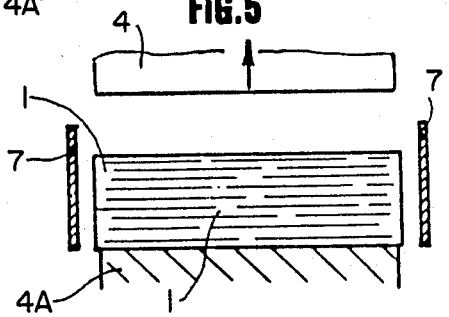
Figure 7:
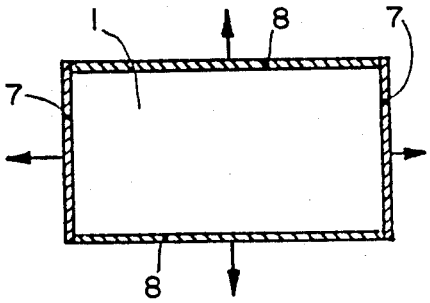

At the end of compacting, the mobile walls (7 and/or 8) are moved a few millimeters away from the corresponding walls of the moulded block and, contrary to the practice in the prior art, cover (4) is maintained in place on block (1) (FIG. 5), which permits the lateral relaxation of the stresses. The cover or the piston or pistons subjects the block to a residual stress of 50–2000 kPa (kilopascals) and preferably between 100 and 500 kPa. After a few seconds (e.g. 1–20 seconds) cover (4) is raised (FIG. 6). The moulded block is removed after opening walls (7) and/or (8) and removing the cover.

Figure 8:
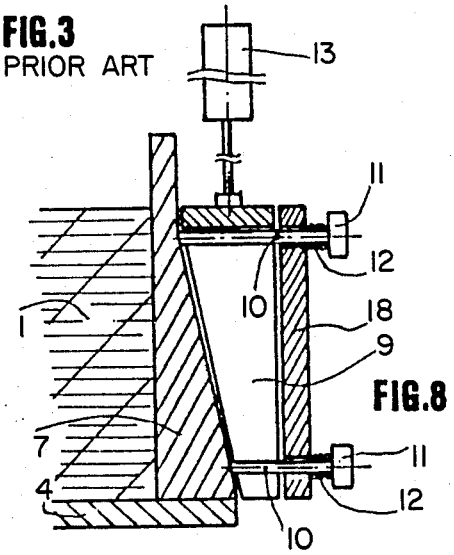

FIG. 8 diagrammatically illustrates an apparatus for performing the invention. Wall (7) is immobilized during compacting by means of the wedge (9), which itself bears on a rigid, fixed post (18). Two guide rods (10) terminated by a head (11) are fixed to wall (7). A spring (12) working in compression is placed between head (11) and the outer wall of the fixed post.

At the end of compacting, wedge (9) is raised by means of jack (13). Under the action of springs (12), head (11) is forced rearwards and pulls on wall (7), which moves back a few millimeters, so that between it and the compressed carbon-containing block (1), there is a space of a few millimeters adequate for ensuring the relaxation of stresses.

This apparatus only constitutes a particular, non-limitative embodiment of the invention for ensuring the lateral release of wall (7) and the maintaining thereof firmly immobilized during compacting.

EXAMPLE

According to the invention, a vibratory tamping means has been equipped with two mobile side walls able to move away from the walls of the block by approximately 5 mm, in accordance with the apparatus of FIG. 8. In the same way, the two doors (8) which rise to permit the discharge of the anode effect a backward movement of 5 mm prior to being raised. Thus, the relaxation of the stresses takes place in the two directions of the horizontal plane (the main stress having been vertical).

The following table gives the comparative results obtained:

| Relaxation of stresses according to the invention | Temperatures of blocks during compacting, °C. | Variation of the dry density* of the carbon-containing blocks compared with the reference block. | Appearance of cracks at the end of compacting. |
|---|---|---|---|
| no | 140 | +0 | no |
| yes | 140 | +0.003 | no |
| no | 145 | — | yes |
| yes | 145 | +0.011 | no |
| no | 150 | — | yes |
| yes | 150 | — | yes |

*The dry density DS is defined compared with the measured bulk density DA by the relation: DS = DA × (1% by weight of pitch).

It can be concluded therefrom that the lateral relaxation of the stresses according to the invention has made it possible to carry out compacting of blocks at 145° C. instead of 140° C. in the absence of lateral relaxation, without there being any crack formation. This has led to an average gain of 0.011 points on the density of the carbon-containing block, which leads to a significant improvement in the quality of the anodes and an elimination of rejects due to cracking.

The lateral relaxation of the stresses stored in the moulded blocks, although still subject to a residual stress in the compacting axis (residual stress below 2000 kPa), makes it possible to raise the temperature at which the cracks appear. Thus, in the case of moulding carbon-containing blocks, it is possible to knead and compact the coke plus pitch mixture at a higher temperature (by at least 5° C.) and thus improve the characteristics of the blocks.

The anodes to be used in the production of aluminium by electrolysis in accordance with the Hall-Héroult process constitute one of the preferred, but non-exclusive fields of use for the present invention.

What is claimed is:

1. In a molding apparatus for shaping by compacting a block comprising aggregate and binder, comprising:

a main mold portion for containing the block, comprising a plurality of side walls and a rigid bottom; and means for applying a monoaxial force to the block contained in the main mold portion, in a direction substantially parallel to the side walls, for compaction of the aggregate and binder;

the improvement comprising:

wedge means for reversibly blocking a pair of opposed side walls in place with respect to the block during application of the force; said wedge means being vertically movable by jack means into and out of facing engagement with said pair of side walls on a face opposite the main mold portion; and horizontally aligned guide means attached to said pair of side walls such that longitudinal movement of said guide means in a direction away from said main mold portion results in translational displacement of said pair of side walls a defined distance away from the block while maintaining application of the force to relieve latent stresses in the block.

2. In a molding apparatus for shaping by compacting a block comprising aggregate and binder, comprising:

a main mold portion for containing the block, comprising a plurality of side walls and a rigid bottom; and means for applying a monoaxial force to the block contained in the main mold portion, in a direction substantially parallel to the side walls, for compaction of the aggregate and binder;

the improvement comprising:

at least one guidance member (10) fixed at one end to a face of a displaceable wall (7), outwardly of said main mold portion, and having a head (11) at its opposite end;

a fixed, rigid post (18) adjacent to said displaceable wall, said at least one guidance member passing through said post;

a detachable wedge (9) located between said displaceable wall and said post; and an elastic compression means located along said guidance member between said post and said head;

said post and said wedge cooperating to serve as a means for reversibly blocking a pair of opposed side walls in place with respect to the block during application of the force; and said guidance member, said post and said compression means cooperating to serve as a means for translationally displacing said pair of walls away from the block while maintaining application of the force to relieve latent stresses in the block.

* * * * *